US005539500A

United States Patent [19]

Hamamichi et al.

[11] Patent Number: 5,539,500

[45] Date of Patent: Jul. 23, 1996

[54] IMAGE FORMING APPARATUS WITH HUMIDITY CONTROLLING DEVICE

[75] Inventors: Suguru Hamamichi, Toyokawa; Naoyoshi Kinoshita, Aichi-Ken; Takeru Kinoshita, Toyokawa; Takanobu Yamada, Toyokawa; Hideo Kitakubo, Toyokawa, all of Japan

[73] Assignee: Minolta Camera Kabushiki Kaisha, Osaka, Japan

[21] Appl. No.: 508,839

[22] Filed: Jul. 28, 1995

Related U.S. Application Data

[63] Continuation of Ser. No. 113,103, Aug. 30, 1993, abandoned.

[30] Foreign Application Priority Data

Aug. 31, 1992 [JP] Japan ..... 4-232209
Aug. 31, 1992 [JP] Japan ..... 4-232212

[51] Int. Cl.[6] ..... G03G 21/20

[52] U.S. Cl. ..... 355/208; 355/215; 355/246; 355/273

[58] Field of Search ..... 355/208, 215, 355/246, 273, 30

[56] References Cited

U.S. PATENT DOCUMENTS

| | | | |
|---|---|---|---|
| 3,634,007 | 1/1972 | Verderber | 355/212 |
| 4,314,755 | 2/1982 | Kinashi | 355/208 X |
| 4,727,385 | 2/1988 | Nishikawa et al. | 355/30 X |
| 4,733,270 | 3/1988 | Nishikawa et al. | 355/327 |
| 4,853,743 | 8/1989 | Nagumo et al. | 355/30 X |
| 4,888,618 | 12/1989 | Ishikawa | 355/208 |
| 5,028,954 | 7/1991 | Yamamoto et al. | 355/30 |
| 5,034,772 | 7/1991 | Suzuki | 355/208 |
| 5,148,218 | 9/1992 | Nakane et al. | 355/208 |
| 5,291,253 | 3/1994 | Kumasaka et al. | 355/208 X |
| 5,311,256 | 5/1994 | Hamamichi et al. | 355/208 |

FOREIGN PATENT DOCUMENTS

| | | |
|---|---|---|
| 53-128748 | 3/1977 | Japan . |
| 52-134733 | 11/1977 | Japan . |
| 53-115233 | 10/1978 | Japan . |
| 58-33271 | 2/1983 | Japan . |

*Primary Examiner*—Nestor R. Ramirez
*Attorney, Agent, or Firm*—Burns, Doane, Swecker & Mathis

[57] ABSTRACT

An image forming apparatus for forming images by an electrophotographic process. The image forming apparatus includes a humidity sensor for detecting the humidity in the area around the image forming members provided therein, a density sensor for detecting the density of images formed on a photoreceptor, and a humidity controller having a dehumidifying unit and a humidifying unit for adjusting the humidity in the area around image forming members. The humidity controller is operated according to humidity historical data generated based on the humidity data outputed from the humidity sensor, a detected photoreceptor potential, a detected amount of developer scattered from the developing unit or the detection result from the density sensor.

25 Claims, 15 Drawing Sheets

IMAGE FORMING APPARATUS WITH HUMIDITY CONTROLLING DEVICE

This application is a continuation of application No. 08/113,103, filed Aug. 30, 1993 now abandoned.

BACKGROUND OF THE INVENTION

FIELD OF THE INVENTION

The present invention relates to an image forming apparatus of the electrophotographic type provided with a humidity controlling device for regulating the humidity around the image forming mechanism.

DESCRIPTION OF THE RELATED ART

In image forming apparatus of the electrophotographic type, the characteristics of the various processes such as charging, exposure, developing, transfer and the like vary in accordance with the humidity, which produces the disadvantage of image quality instability.

To eliminate the aforesaid disadvantage, it has been proposed that a humidity sensor be provided to detect the humidity within the copying apparatus of the electrophotographic type, and the toner density automated regulation function is corrected in accordance with the output of said humidity sensor, so as to correct the developing conditions. Furthermore, to eliminate the effects of humidity, it has been proposed that the amount of toner adhering onto the surface of the photosensitive member should be detected and the developing bias and amount of exposure light controlled via the feedback of said detection results.

None of the aforesaid proposed methods can be implemented in accordance with changes in the characteristics of the various processes other than the developing process, e.g., such as the transfer process and the like.

Thus, individually correcting the characteristics of the various processes comprising the electrophotographic process in accordance with the output of a humidity sensor has been considered. However, such a method produces extreme complexity of the copying apparatus and markedly increases the cost, thereby taking such a solution impractical.

Even though the characteristics of the individual processes comprising the electrophotographic process are corrected in accordance with the output of a humidity sensor, variations in the characteristics of said individual processes are such that precise correction is impossible due to inherent delays. Suppressing fluctuations in the image caused by the humidity is also difficult and leads to further problems.

Technology has been developed to detect the humidity in the specific area around the photosensitive member within the copying apparatus, and adjust the humidity of said specific area in accordance with the detection results.

The aforesaid technology allows the humidity to be adjusted with relatively better response characteristics. However, when this kind of humidity regulation is accomplished in all processes having characteristics affected by humidity, the copying apparatus becomes quite complex and expensive, rendering such a solution impractical. When humidity is adjusted by using the humidity of a specific area within the copying apparatus as the humidity throughout the copying apparatus in general, there is a time differential from the detection of the humidity of said specific area until the overall humidity within the copying apparatus achieves the humidity of said specific area. Precise humidity regulation is therefore impossible due to the aforesaid time differential.

On the other hand, it has been proposed that the toner supplied within the developing device pass through a recyclable hygroscopic agent to remove the moisture and achieve image forming stability.

However, although variations of the charging characteristics of the toner induced by humidity can be avoided by the aforesaid method, other changes in characteristics of the electrophotographic process are entirely unaffected.

It therefore has been proposed that a dehumidifying means using a recyclable dehumidifying agent be provided within the copying apparatus to remove moisture and achieve stability in image formation.

Dehumidification within the copying apparatus simply by a dehumidifying means is difficult to achieve in response to rapid changes or large changes in environmental conditions. An inherent problem in such a scheme is the difficulty in accurately maintaining a predetermined humidity within the copying apparatus.

SUMMARY OF THE INVENTION

A main object of the present invention is to provide an image forming apparatus capable of forming images of stable quality.

Another object of the present invention is to provide an image forming apparatus capable of rapid and accurate regulation of humidity within the copying apparatus.

These and other objects of the present invention are achieved by providing an image forming apparatus comprising:

- image forming means for forming images by an electrophotographic process;
- adjusting means for adjusting the humidity in the area around the image forming means;
- detecting means for detecting the humidity in the area around the image forming means;
- generating means for generating humidity historical data based on said detected humidity; and
- control means for operating said humidity regulating means in accordance with said generated historical data, These and other objects of the present invention are further achieved by providing an image forming apparatus comprising:

- image forming means for forming images by means of an electrophotographic process;
- adjusting means for adjusting the humidity in the area around the image forming means;
- detecting means for detecting the electrophotographic characteristics relating to humidity in the area around the image forming means;
- control means for operating said humidity regulating means in accordance with said detected electrophotographic characteristics, These and other objects, advantages and features of the invention will become apparent from the following description thereof taken in conjunction witch the accompanying drawings which illustrate specific embodiments of the invention.

BRIEF DESCRIPTION OF THE DRAWINGS

In the following description, like parts are designated by like reference numbers throughout the several drawings.

Figure 20:
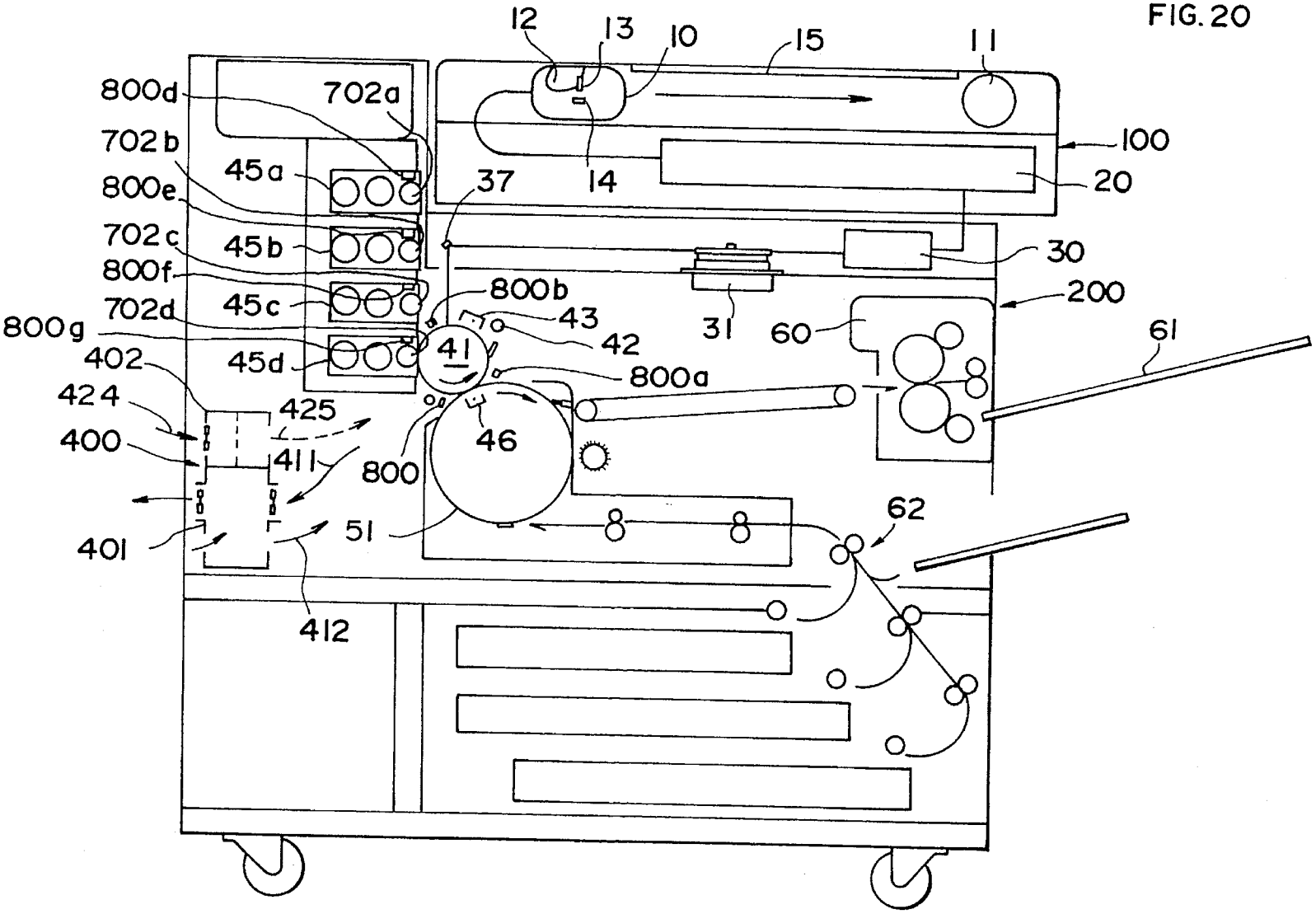

FIG, 19 is an illustration showing the general construction of a digital color copying apparatus of the sixth embodiment of the invention;

FIG. 20 is an illustration showing the general construction of a digital color copying apparatus of a seventh embodiment of the invention.

DETAILED DESCRIPTION OF THE PREFERRED EMBODIMENTS

Figure 1:
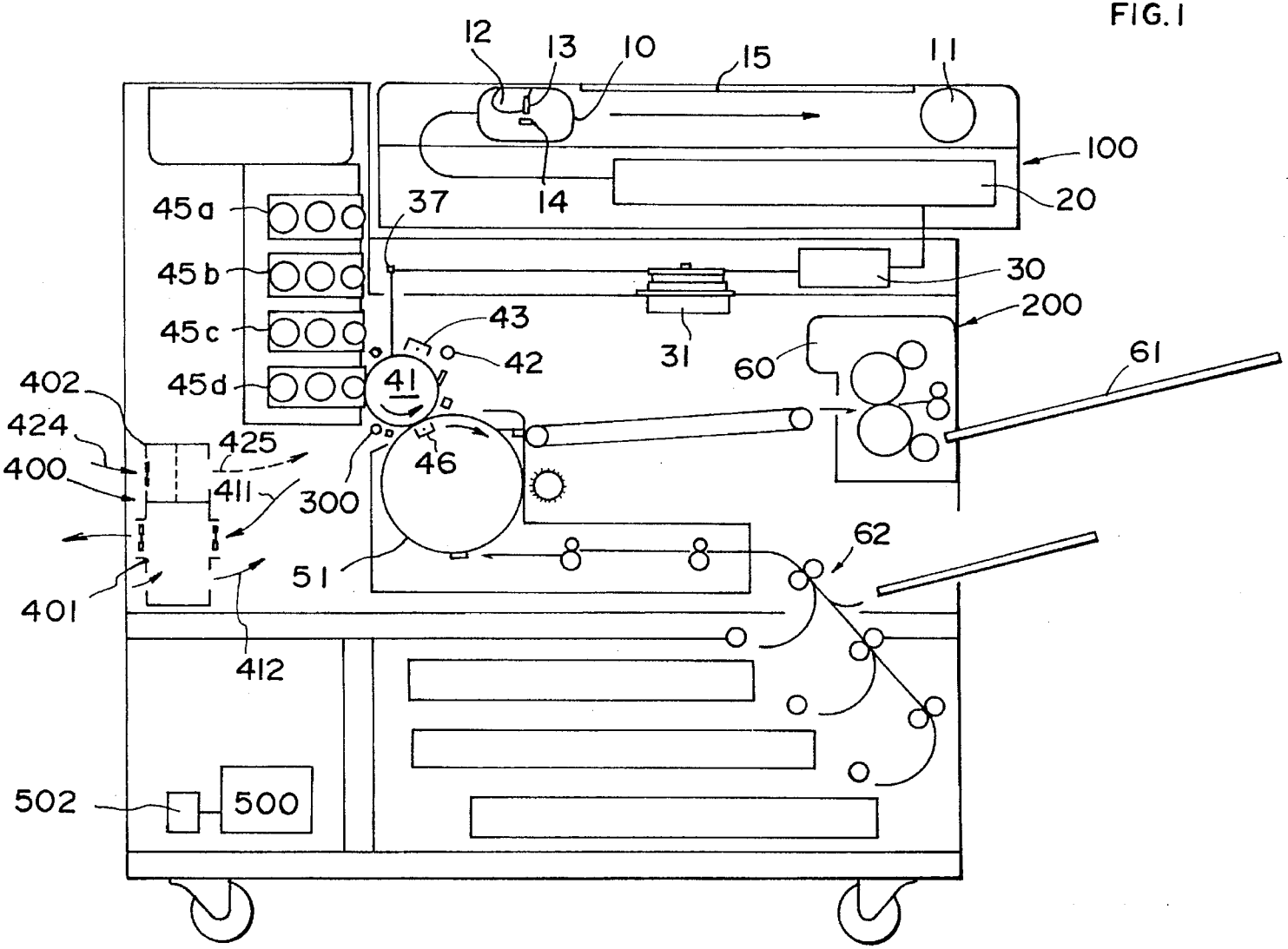
FIG. 1 is an illustration showing the general construction of a digital color copying apparatus of the first embodiment of the invention.

FIG. 1 shows the general construction of a digital color copying apparatus of the first embodiment of the invention.

This digital color copying apparatus can be broadly divided into the image reader portion 100 for reading original document images, and the copying portion 200 for reproducing the image read by the image reader portion 100.

In the image reader portion 100, the scanner 10 comprises an exposure lamp 12 for illuminating an original document, rod lens array 13 for condensing the reflected light from the original document, and a sealed type CCD (charge-coupled device) color image sensor 14 for converting the condensed light into electrical signals. During original document image reading, the scanner 10 is driven via a motor 11 so as to move in the arrow direction (subscanning direction) and thereby scan an original document disposed on the platen 15. The image on the surface of the original document is illuminated by the exposure lamp 12, and converted into electrical signals by the image sensor 14.

The multi-level electrical signals for the three colors R, G and B derived via the image sensor 14 are converted into the relevant 8-bit gradient data of yellow (Y), magenta (M), cyan (C), or black (K) via the reading signal process section 20, and stored in the synchronization buffer memory 30.

Then, in the copying portion 200, the print head 31 accomplishes gradient correction (gamma correction) in accordance with the gradient characteristics of the photosensitive member relative to the input gradient data. Thereafter, the corrected image data are subjected to analog-to-digital (A/D) conversion to generate laser diode drive signals which induce the semiconductor laser to emit modulated light.

The laser beam, which is emitted from the print head 31 in relation to the gradient data, irradiates the surface of the rotatably driven photosensitive drum 41 via the reflecting mirror 37. Before receiving the exposure light of each copy, the photosensitive drum 41 is irradiated by the eraser lamp 42, and the surface thereof is uniformly charged by the charger 43. When the charged surface of the photosensitive drum 41 is irradiated by the exposure light: an electrostatic latent image of the original document is formed thereon. Only one among the developing devices 45*a* through 45*d*, which respectively contain toners of the separate colors cyan, magenta, yellow, and black, is selected, and the electrostatic latent image formed on the surface of the photosensitive drum 41 is developed. The developed toner image is transferred from the photosensitive drum 41 onto a copy sheet wrapped around the transfer drum 51 via the transfer charger 46.

After the four colors have been transferred onto the copy sheet, said copy sheet is separated from the transfer drum 51 and transported to the fixing section 60. After the fixing process is completed, the copy sheet is discharged to the tray 61. Reference numeral 62 in the drawing refers to the paper supply section.

In the previously mentioned copying section 200, the image formation of the electrophotographic process is greatly affected by changes in environmental humidity.

Figure 8:
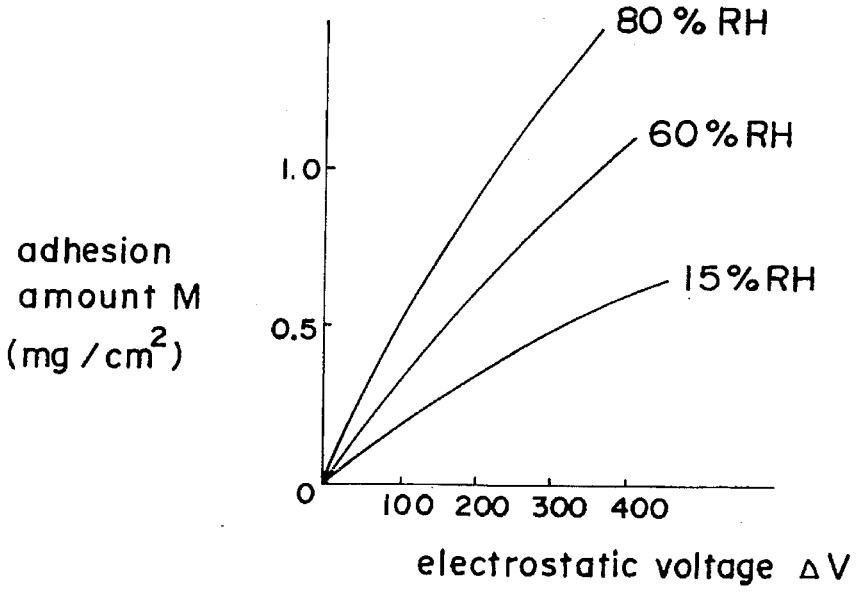
FIG. 8 is a graph showing the correspondence between humidity and image density.

For example, FIG. 8 shows the humidity-dependent trends of developing characteristics. As can be understood from FIG. 8, as the humidity becomes higher, the developing material adhesion amount M adhering to the photosensitive drum increases, thereby increasing image density. This tendency causes the charge amount of the developing material to change mainly due to the humidity, and results from changes in the adhesion amount characteristics relative to the developing potential $^{\Delta}V$ (developing bias potential $V_B$-latent image potential $V_i$).

In order to prevent the aforesaid changes in the electrophotographic process characteristics via the environmental humidity, the present embodiment provides that the humidity within the copying section 200 is detected by the humidity sensor 300, humidity historical data are derived at predetermined time units, and the humidity within the copying section 200 is adjusted via the humidity controller 400 in accordance with said historical data.

Thus, the humidity within the copying section 200 is adjusted on average so as to maintain a suitable humidity without the affects of temporal delays in humidity regulation. Therefore, stability is maintainable among all the various characteristics of the electrophotographic process which are affected by humidity.

The previously mentioned humidity sensor 300 is disposed in proximity to the photosensitive drum 41, as shown in FIG. 1, in an area wherein changes in humidity significantly affect the electrophotographic process characteristics.

Figure 2:
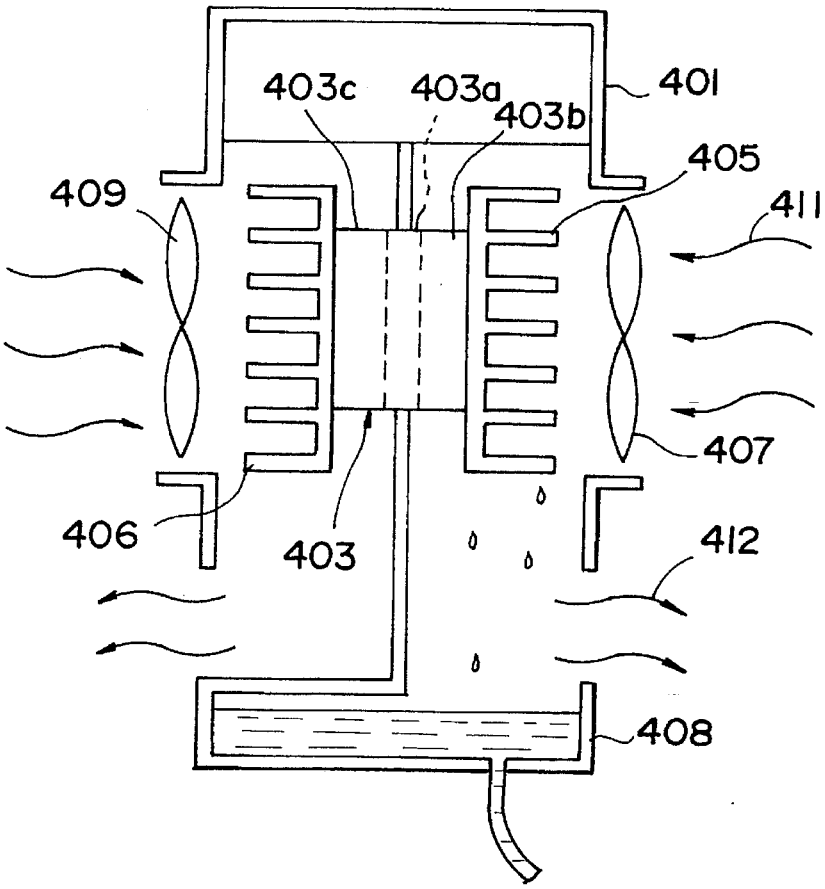
FIG. 2 is a section view of the dehumidifying unit of the present invention.
Figure 3:
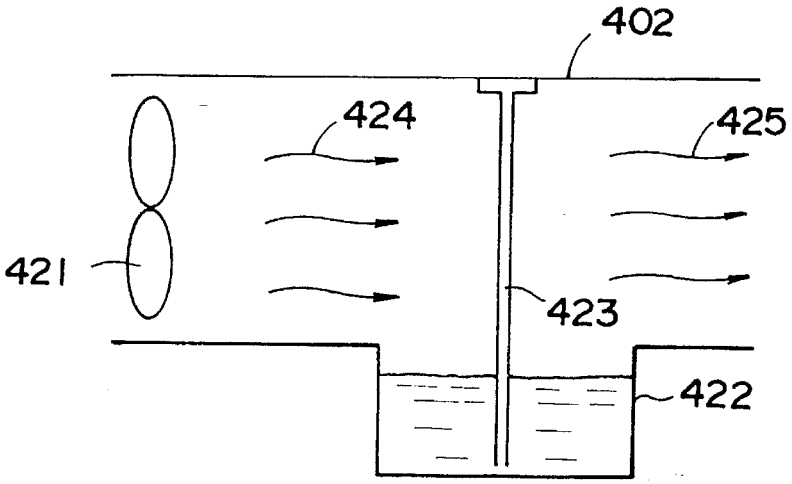
FIG. 3 is a section view of humidifying unit of the present invention.

The humidity controller 400 comprises a dehumidifying unit 401, as shown in FIG. 2, and a humidifying union 402, as shown in FIG. 3.

The dehumidifying unit 401 uses a Peltier element 403.

The Peltier element 403 comprises a P/N interface 403*a* having bilaterally provided a low temperature portion 403*b* and a high temperature portion 403*c*, respectively. Cooling fins 405 and heat dissipating fins 406 are individually connected to the aforesaid low temperature portion 403*b* and high temperature portion 403*c*, respectively.

In the dehumidifying unit 401, the air 411 containing the moisture within the copying portion 200 is directed to the interior of the dehumidifying unit 401 by the ventilation fan 407. The moisture in the air is condensed by the cooling fins 405 provided on the low temperature portion 403*b* of the Peltier element. 403 so as to form droplets, which are collected in the reservoir 408. The air 412 from which the moisture has been removed is expelled outside the dehumidifying unit 402.

At this time, the high temperature portion 403*c* of the Peltier element 403 is cooled by means of the ventilation fan 409 via the heat dissipating fins 406 attached thereto. The cooling efficiency of the low temperature portion 403*b* of the Peltier element 403 is thereby improved, which improves the dehumidifying efficiency.

The humidifying unit 402 is such that the water which has normally collected in the water reservoir tank 422 impregnates the membrane 423 which is maintained in a moist state, as shown in FIG. 3. Thus, the air 424 circulated by the ventilation fan 421 becomes humidified air 425 by passing through the aforesaid membrane 423. The humidified air 425 is then circulated within the interior of the copying portion 200, thereby accomplishing humidification.

Figure 4:
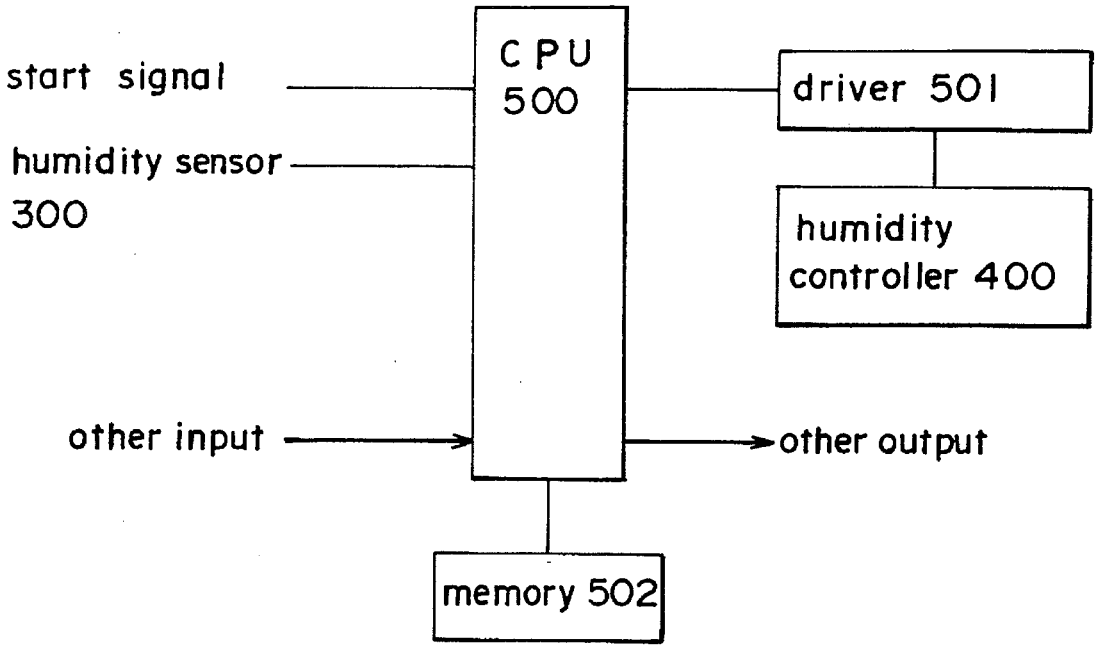
FIG. 4 is a block diagram of the essential part of the control circuit of the first embodiment.

In the present embodiment, A central processing unit (CPU) 500 is used to control the operation of the copying apparatus shown in FIG. 4 to effect the previously described humidity regulation.

Other than the start signal, the output of the humidity sensor 300 and other input signals are input to the CPU 500. The CPU 500 outputs operation signals for the humidity controller driver 501 to drive the dehumidifying unit 401 and the humidifying unit 402 of the humidity controller 400, as well as other output signals. The memory 502 for generating the humidity historical data is connected to the CPU 500. It is to be noted, however, that a CPU 500 memory function may alternatively be used instead of the memory 502.

Figure 5:
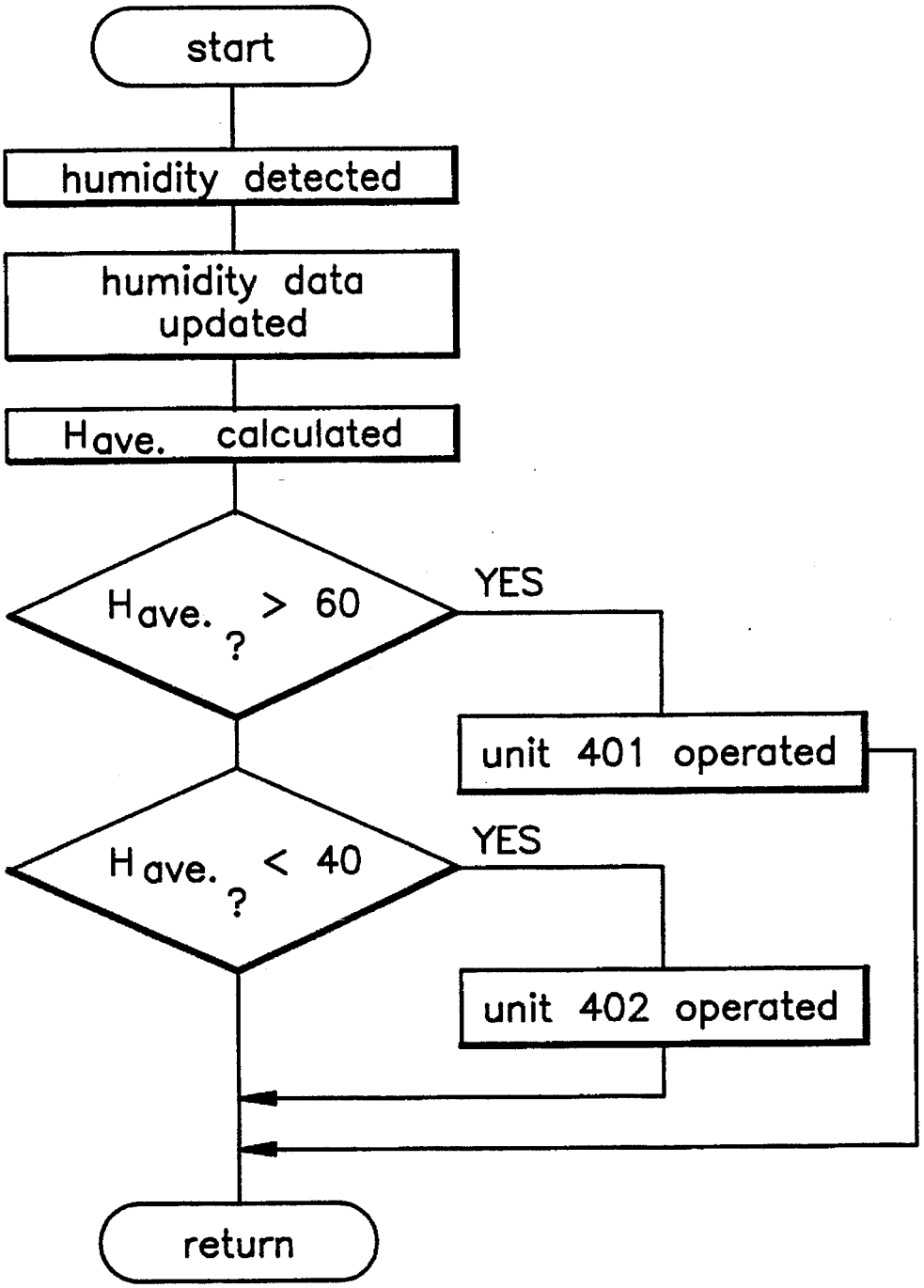
FIG. 5 is a flow chart showing the control content of the humidity regulation accomplished via the control circuit of FIG. 4.

FIG. 5 is a flow chart showing the main content of the humidity regulating controls accomplished via the control circuit of FIG. 4.

According to these controls, the data detected by the humidity sensor 300 are sequentially stored in the memory 502 which stores the humidity data within predetermined time units for the preparation of historical data. For example, humidity data detected within three hour units is sequentially stored in the memory 502, and said sequentially data are updated by new data. The historical humidity data are generated by calculating the historical average humidity $H_{ave}$. at the predetermined time units.

Figure 6:
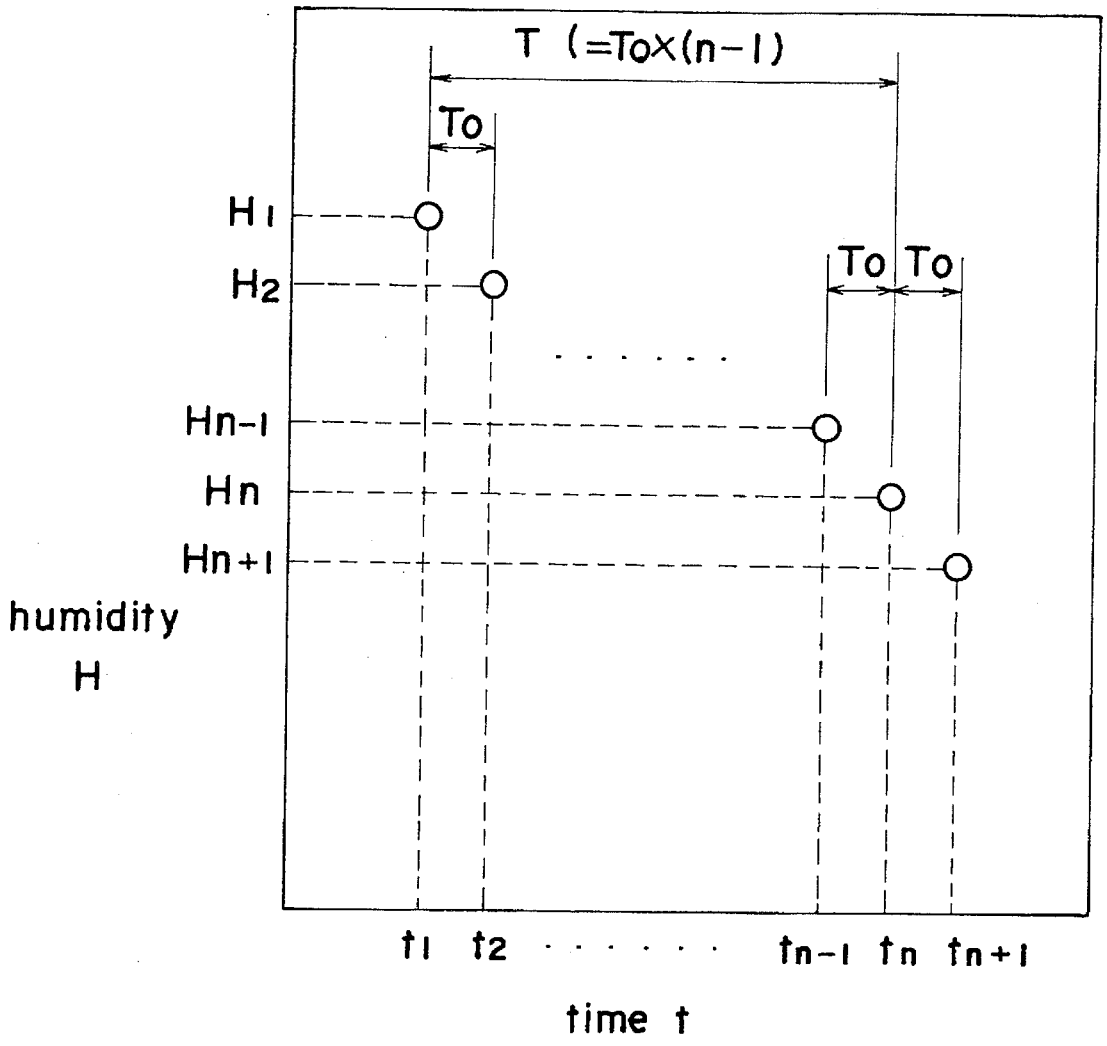
FIG. 6 is an illustration of the memory method used for the humidity historical data.

FIG. 6 shows the memory method used for the historical data of humidity detected by the humidity sensor 300. In the drawing, the sampling interval is designated $T_o$, and the object period of historical data calculation is designated T. When the humidity at time $t_n$ is sampled, the humidity data of time $t_1$ ($t_1=t_n-T$) thereafter are stored in memory. The average humidity at that time is derived as shown in Equation (1) below. [Eq. 1](when $t=t_a$)

$$H_{ave}=\frac{H1+H2+\ldots Hn}{n}=\sum_{n=1}^{a} /n \tag{1}$$

Subsequently, after $T_o$ seconds, the value $H_{ave}$ obtained via Equation (1) is effective until the next sampling at time ($t_{n+1}$). However, when the humidity $H_{n+l}$ sampled at time $t_{n+1}$ is saved in memory, and at the same time the oldest data $H_1$ are eliminated. That is, the humidity data ($H_2$, $H_3$, . . . $H_{n+1}$) after $t_2$ are saved in memory. The average humidity $H_{ave}$ at this time ($t=t_{n+1}$), is obtained via Equation (2) below. [Eq. 2](when $t=t_{n+1}$)

$$H_{ave}=\frac{H2+H3+\ldots Hn+1}{n}=\sum_{n=2}^{n+1} /n \tag{2}$$

Thereafter, this cycle is repeated, and the historical data are updated.

The humidity is determined to be high if the aforesaid historical data $H_{ave}$ is greater than a predetermined humidity of 60% relative humidity (RH). In this case, the dehumidifying unit 401 is actuated, and the routine returns.

Conversely, the humidity is determined to be low if the return $H_{ave}$ is less than a predetermined humidity of 40% RH. In this case, the humidifying unit 402 is actuated and the routine returns.

In this way, a suitable humidity is maintained within the copying portion 200, and fluctuations in the various characteristics of the electrophotographic process induced by humidity can be prevented so as to stabilize image quality.

Figure 7:
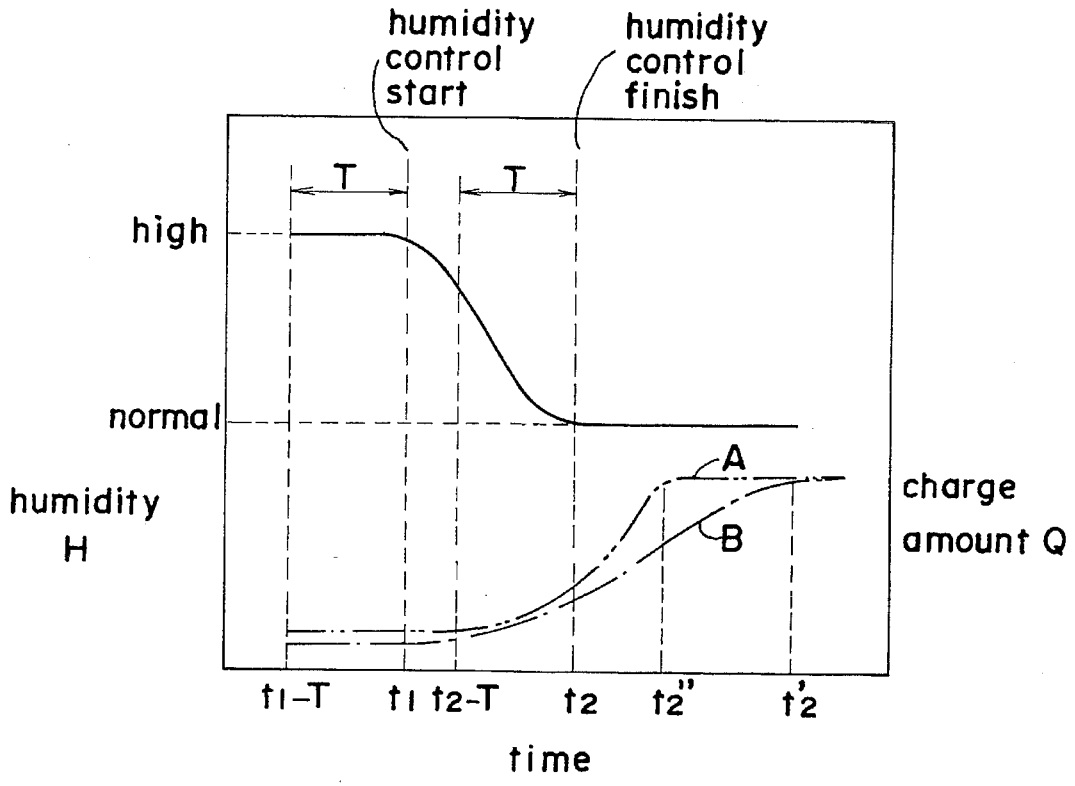
FIG. 7 is a graph showing the temporal relationship between the change in humidity via humidity regulation and the amount of charge of the developing material as a comparison between the first embodiment and a conventional arrangement

The solid line and imaginary line A in FIG. 7 express experimental data describing the change in humidity and change in the charge amount of the developing material when the humidity is automatedly adjusted from the high humidity state to the normal humidity state via the aforesaid control.

In FIG. 7, the dashed line expresses the characteristics B of the change in charge amount relative to the change in humidity when the existing humidity is detected and humidity control is accomplished based on said detection results.

The curves A and B trace identical paths until time $t_2$, but in the case of curve B the charge amount value Q attains the normal humidity state at time $t_2$ because the dehumidification is stopped at time $t_2$. Conversely, in the case of curve A the historical data indicates high humidity at time $t_2$, such that the charge amount value Q attains the normal humidity state at time $t_{2''}$. via continuous dehumidification. That is, the charge amount Q attains the normal humidity state more rapidly at time ($t_2'-t_2''$) by humidity control characteristics of curve A.

The charge amount Q is controllable with greater precision by using as the humidity historical data temporal weighted functions, rather than simple average humidity.

Ripples in the fluctuation of the charge amount Q can be minimized by switching the output level of the humidity controller 400 in accordance with the humidity data.

The input current value of the Peltier element, ventilation fan airflow and the like may be used effectively as the method for switching the aforesaid output level.

Furthermore, an alarm means may be provided to alert the user when the ventilation fan stops, or abnormal fan temperature is detected, so as to minimize malfunctions of the humidity controller 400. When the aforesaid abnormalities are detected, i.e., when the humidity exceeds a predetermined range, miss-copies can be prevented by stopping the copying apparatus.

A second embodiment of the present invention is described hereinafter. The digital color copying apparatus of the second embodiment of the invention is identical in construction to that of the first embodiment. Therefore, further discussion of its construction is omitted form the following description.

In the first embodiment, historical humidity data were derived from the humidity detected by the humidity sensor within the copying portion 200, and the humidity within said copying portion 200 was controlled by the humidity controller 400 in accordance with the aforesaid historical humidity data. Conversely, in the second embodiment, the density (ID) of the developed image formed on the surface of the photosensitive drum and affected by the current humidity is detected by the AIDC sensor 800 shown in FIG. 9, and the humidity within the copying portion 200 is controlled via the humidity controller 400 in accordance with the aforesaid detection results.

The humidity within the copying portion 200 can be suitably controlled by regulating the humidity in accordance with the detection results of the aforesaid AIDC sensor 800, so as to avoid the delays and the like incurred based on a single value of characteristics of the electrophotographic process which are affected by humidity. Thus, the various characteristics of the electrophotographic process which are affected by humidity can be stabilized via suitable humidity control.

The AIDC sensor 800 is an image density sensor used to give image density feedback for developing bias and exposure light control, and automatically correct changes in image density over time. The AIDC sensor 800 is disposed at the upstream side from the transfer section with respect to a rotation direction of the photosensitive drum 41, and may be used in conjunction therewith.

The detection and correction of image density may be accomplished, for example, by forming a test pattern on the non-image portion of the photosensitive drum 41, and detecting the density of said test pattern.

Humidity control may be accomplished together with said image density detection, or accomplished individually with suitable timing.

The humidity controller 400 of the second embodiment is constructed identically to the humidity controller of the first embodiment, and further discussion of said construction is therefore omitted from this description.

Figure 10:
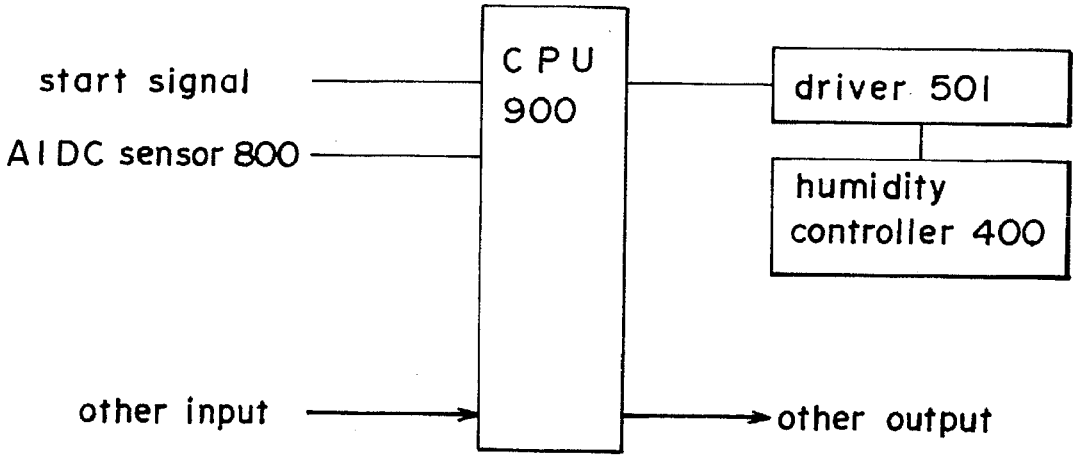
FIG. 10 is a block diagram showing the essential part of the control circuit of the second embodiment.

In the present embodiment, the CPU 900, shown in FIG. 10, is used to control the operation of the copying apparatus, and is used for the previously described humidity control.

Figure 11:
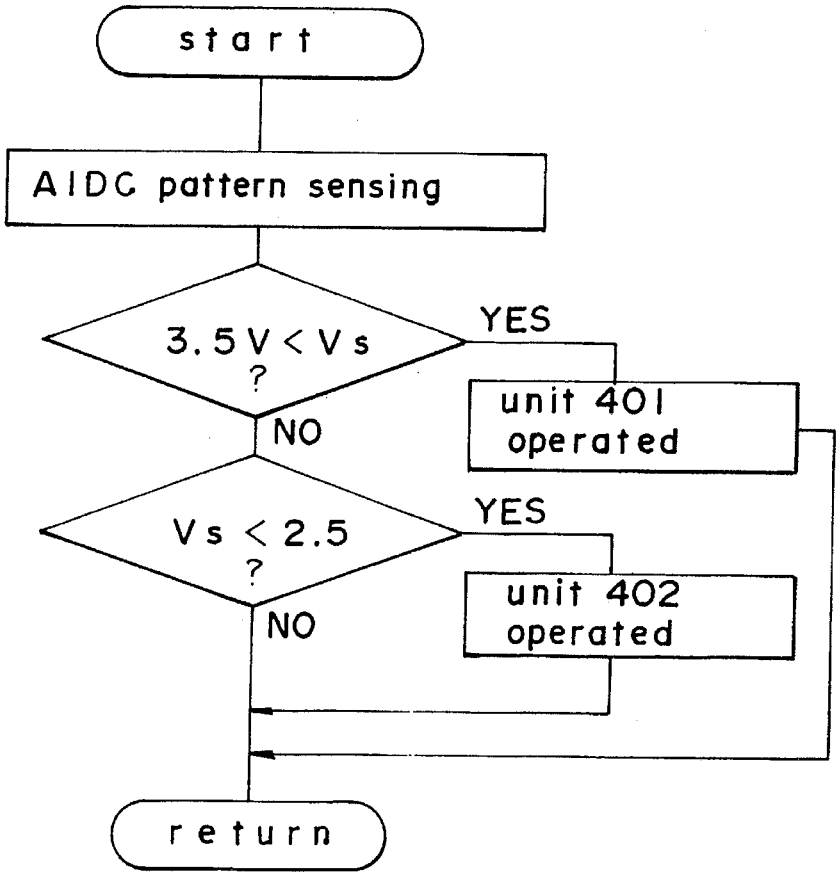
FIG. 11 is a flow chart showing the control content of the humidity regulation accomplished via y control circuit of FIG. 10.

Therefore, in addition to the start signal, the output of the AIDC sensor 800 and other input signals are input to the aforesaid CPU 900. The CPU 900 outputs operation signals to the humidity controller driver 501 to drive the Peltier element 403, dehumidifying unit 401 and humidifying unit 402 of the humidity controller 400, FIG. 11 is a flow chart showing the main contents of the humidity regulating controls accomplished by the control circuit of FIG. 10.

If the output Vs is greater than a predetermined value, e.g., 3.5 V, when the image density of the developed test pattern is detected by the AIDC sensor 800, the image density is determined to be high due to high humidity. Therefore, the dehumidifying unit 401 is actuated and the routine returns.

Conversely, if the output Vs is less than a predetermined value, e.g., 2.5 V, the image density is determined to be low due to low humidity. Therefore, the humidifying unit 402 is actuated and the routine returns.

Thus, the humidity of the copying portion 200 is controlled so as to obtain an image density within a constant range. Humidity-induced fluctuation of all the various characteristics of the electrophotographic process can be suppressed by means of the aforesaid humidity control.

Figure 12:
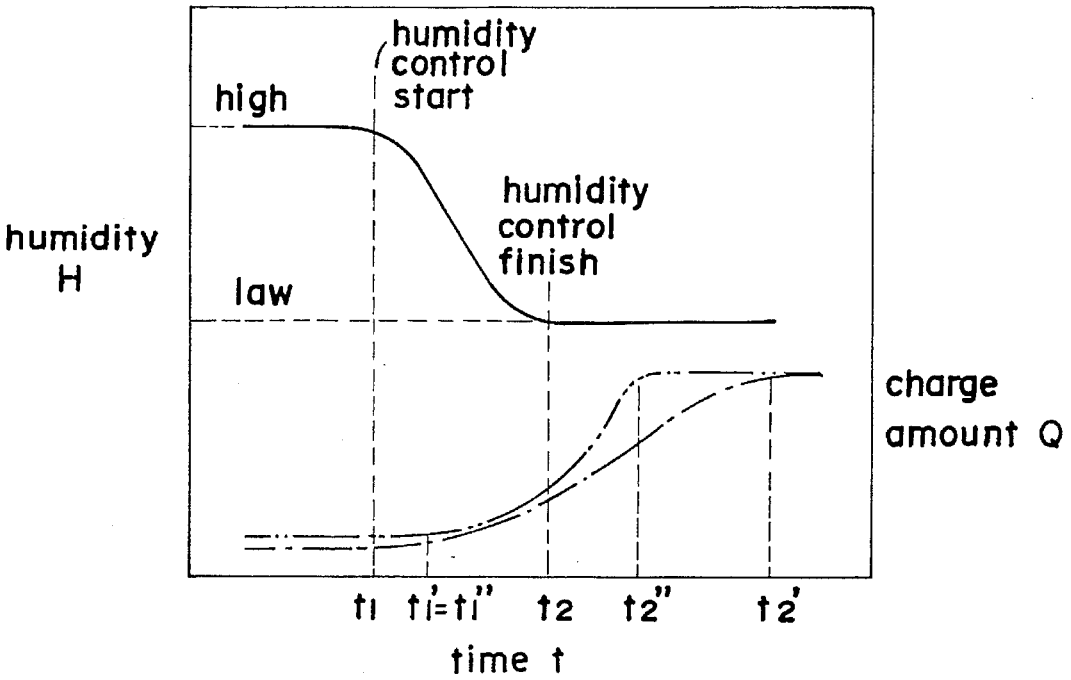
FIG. 12 is a graph showing the temporal relationship between the change in humidity via humidity regulation and the amount of charge of the developing material as a comparison between the second embodiment and when humidity is adjusted via humidity detection.

The solid line and imaginary line in FIG. 12 express experimental data describing the change in humidity and change in the charge amount of the developing material when the humidity is automatedly adjusted from the high humidity state to the normal humidity state via the aforesaid control.

In FIG. 12, the dashed line expresses the characteristics of the change in charge amount relative to the change in humidity when the existing humidity is detected and humidity control is accomplished based on said detection results.

As can be understood from FIG. 12, in the case of conventional humidity detection and control, the humidity control stops at time $t_2$, such that the charge amount Q of the developing material attains the normal humidity state at time $t_2'$. In the present embodiment, however, humidity control is executed until the charge amount Q attains the normal humidity state, such that the charge amount Q is stable at time $T_2''$. Thus, the charge amount Q of the developing material attains the normal humidity state more rapidly at time $(t_2'-t_2'')$ in the present embodiment.

Figure 9:
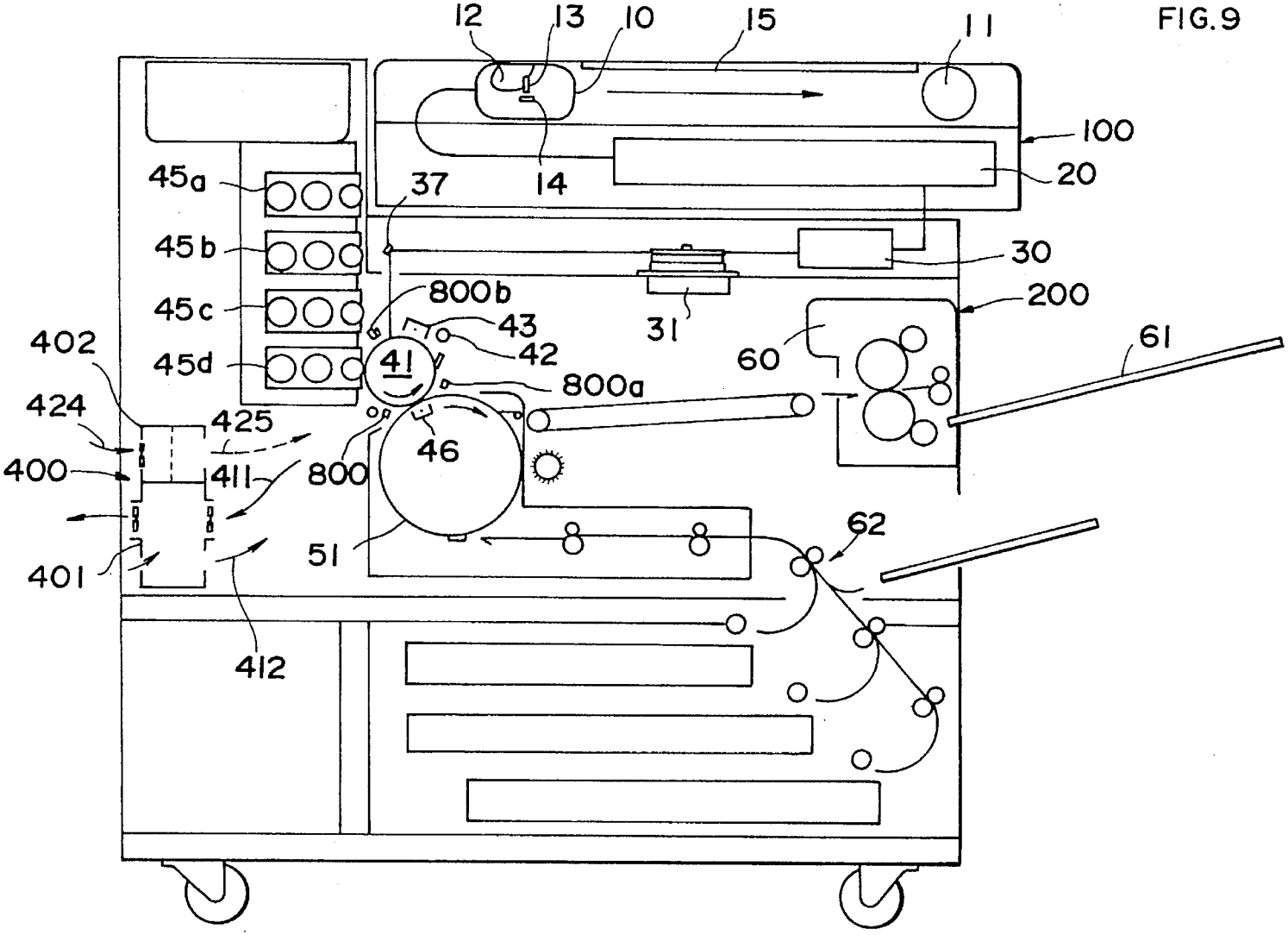
FIG. 9 is an illustration showing the general construction of a digital color copying apparatus of the second embodiment of the invention.
Figure 13:
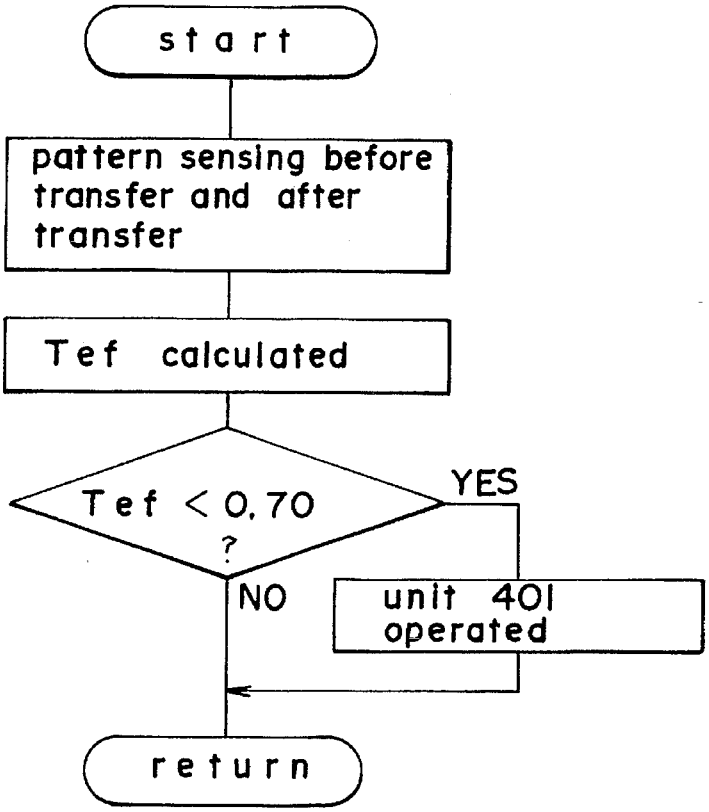
FIG. 13 is a flow chart showing the content of the humidity regulating controls of a third embodiment of the invention.

FIG. 13 is a flow chart showing the humidity regulating controls of a third embodiment of the invention. In this embodiment, the AIDC sensor 800 prided at the upstream side from the transfer section with respect to the rotation direction of the photosensitive drum 41, and the AIDC sensor 800*a* provided at the downstream side from the transfer section, as shown in FIG. 9, detect the image density of a test pattern before and after the transfer process, and the transfer efficiency $T_{ef}$ is calculated from said image density data obtained before and after the transfer process.

The dehumidifying unit 401 is actuated only when the transfer efficiency $T_{ef}$ resulting form the aforesaid calculations is less than a predetermined value of 0.70.

In the case wherein the humidity is less than normal humidity, a significant difference in the transfer efficiency does not arise. Therefore, the present embodiment, the dehumidifying unit 401 is actuated only when the transfer efficiency at high humidity is less than 70%.

Figure 14:
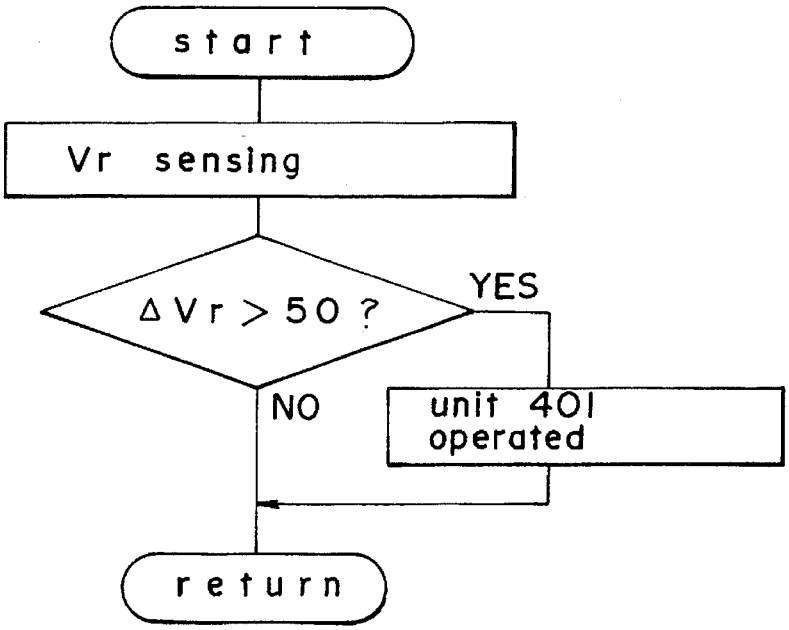
FIG. 14 is a flow chart showing the content of the humidity regulating controls of a fourth embodiment of the invention.

FIG. 14 is a flow chart showing the humidity regulating controls of a fourth embodiment of the invention.

The present embodiment uses the characteristic of the increase in variation width $^{\Delta}Vr$ of the residual potential Vr of the photosensitive drum 41 at high humidity. For example, the flow chart indicates that the dehumidifying unit 401 is operated (dehumidification) when $^{\Delta}Vr>50$.

Thus, the same effectiveness is achieved as when the AIDC sensor 800 is used. In this case, a surface potential sensor 800*b* is provided, as shown in FIG. 9, to detect the surface potential of the photosensitive drum 41.

The AIDC sensor 800 and the surface potential sensor 800*b* are used in concert. Greater effectiveness is achieved in image quality stabilization by controlling humidity based on the detection results of the aforesaid two sensors.

Figure 15:
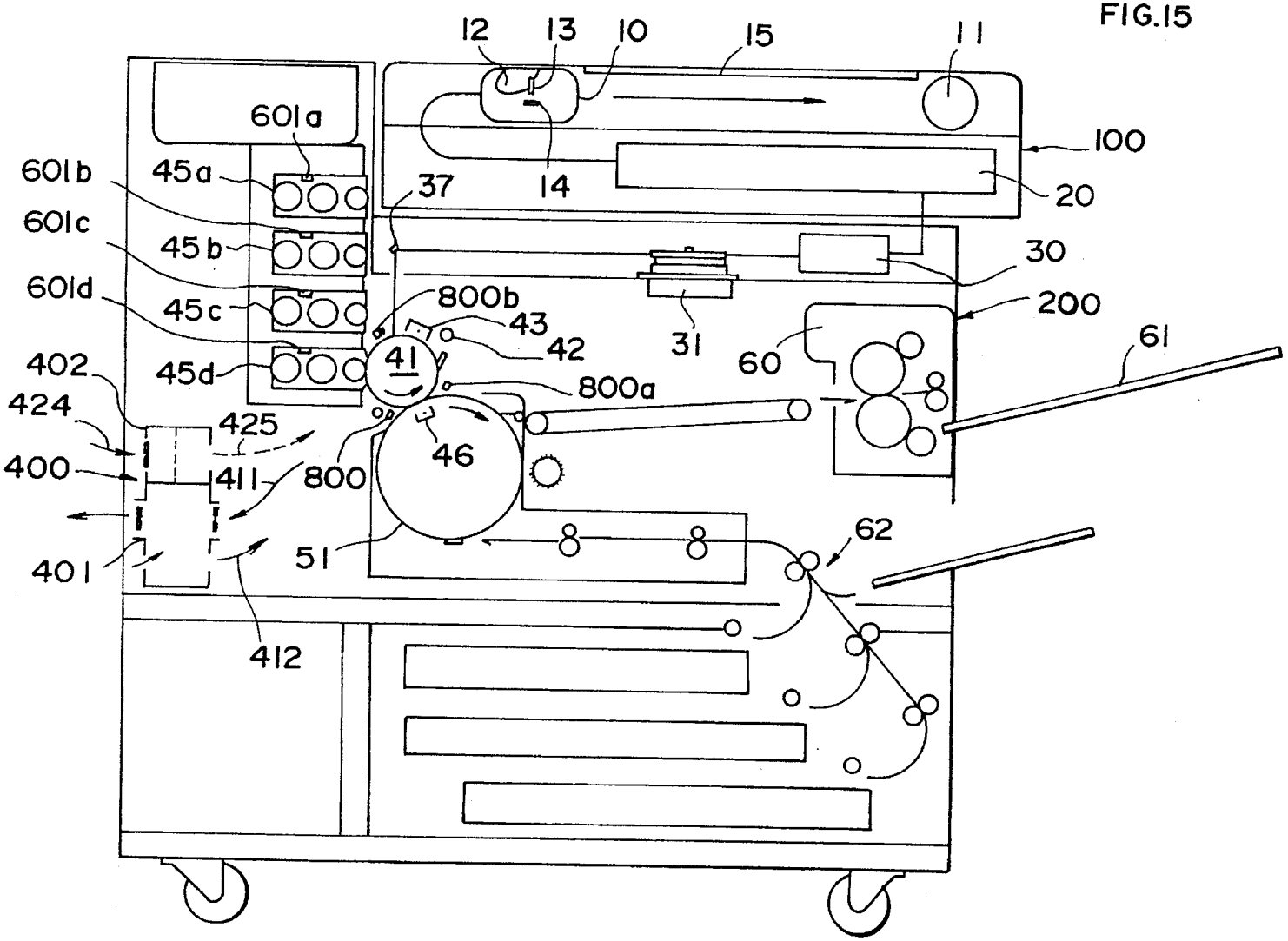
FIG. 15 is an illustration showing the general construction of a digital color copying apparatus of the fifth embodiment of the invention.

FIGS. 15 through 18 show a fifth embodiment of the invention. The copying apparatus of the fifth embodiment is provided with ATDC sensors 601*a*~601*d* of the magnetic type for detecting the volume density of two-component developing materials accommodating in the respective developing devices 45*a*~45*d*, as shown in FIG. 15. The humidity control is accomplished in accordance with the detection results of said sensors 601*a*~601*d* disposed in said developing devices 45*a*~45*d*.

Figure 16:
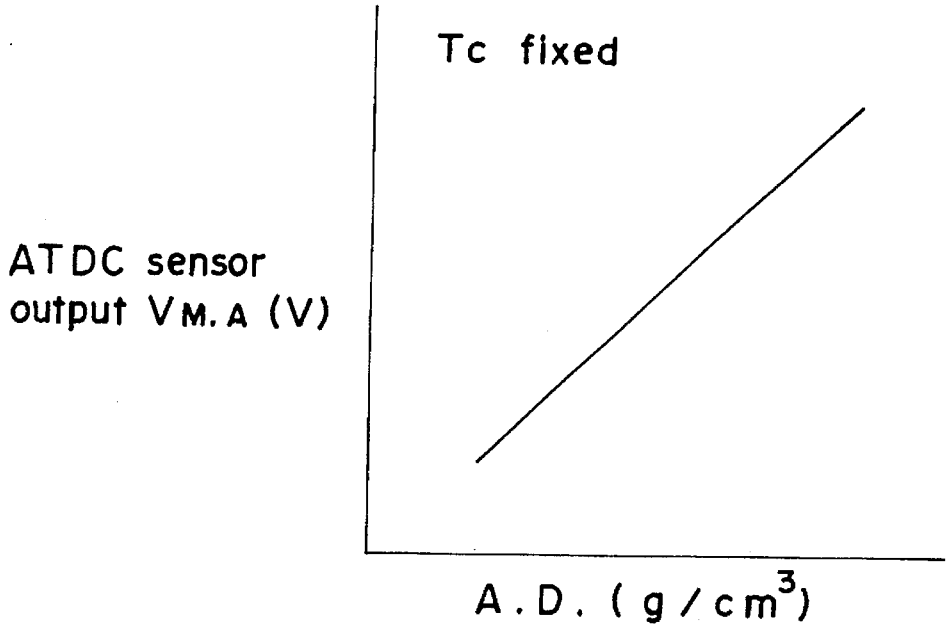
FIG. 16 is a graph showing the relationship between output of a magnetic type ATDC sensor and the developing material volume density in the fifth embodiment.
Figure 17:
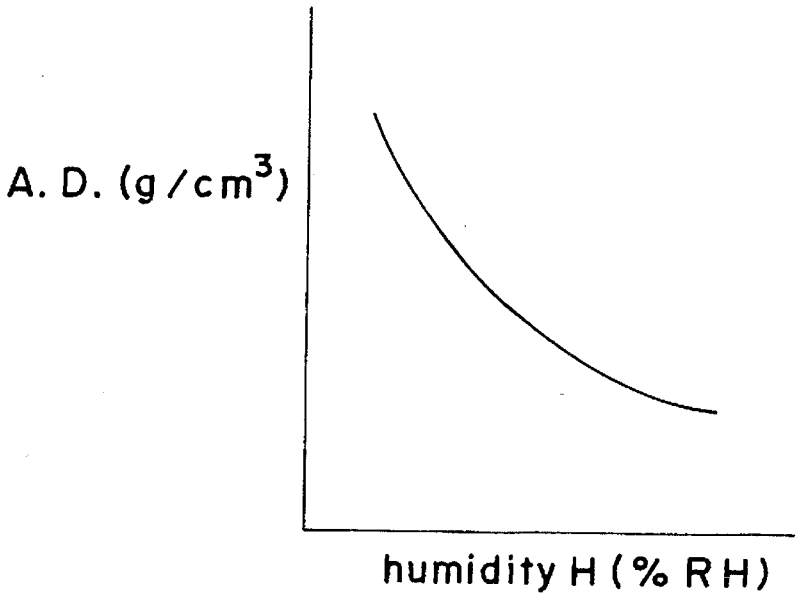
FIG. 17 is a graph showing the correspondence between humidity and volume density.
Figure 18:
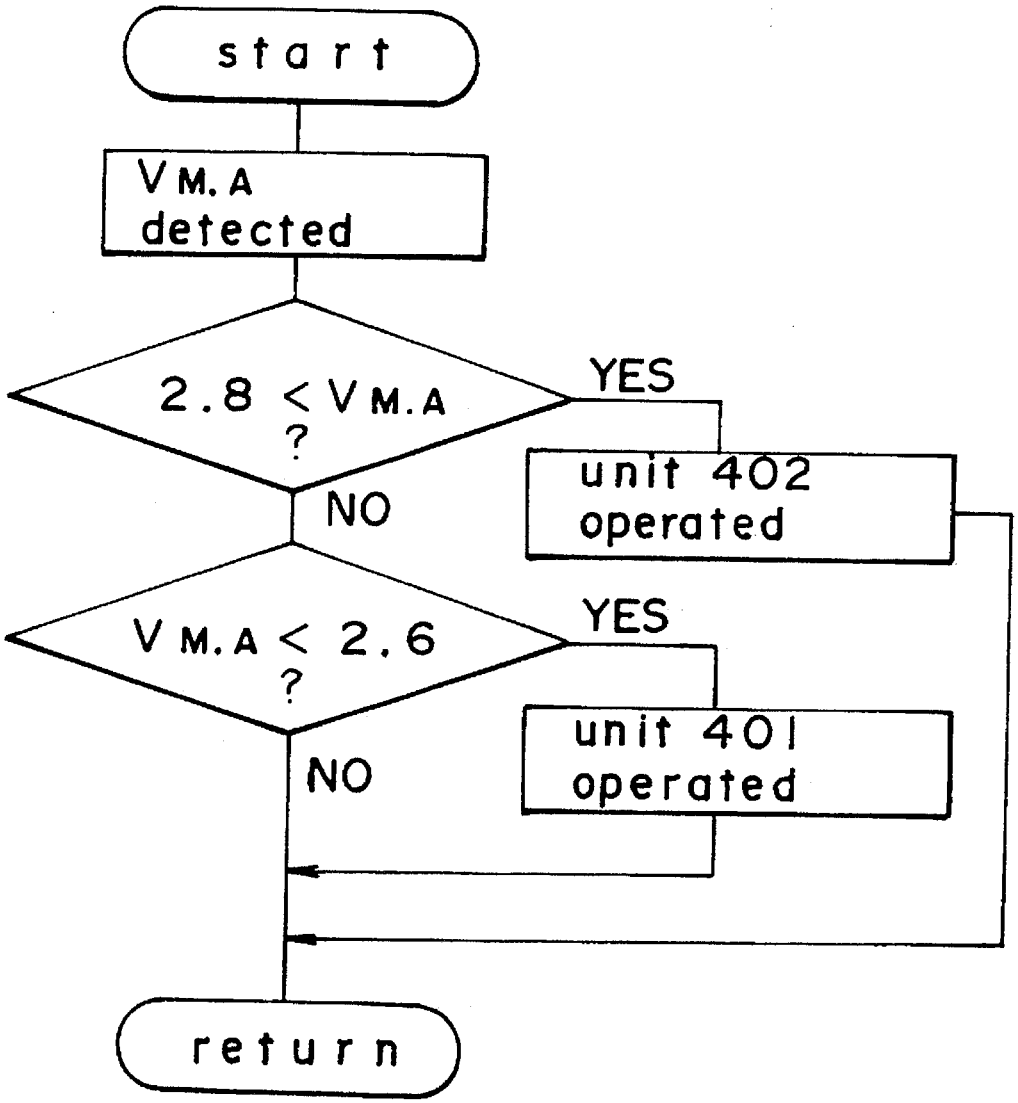
FIG. 18 is a flow chart showing the content of the humidity regulating controls of the fifth embodiment.

As shown in FIGS. 16 and 17, the volume densities (AD) of the developing materials change in conjunction with the change in humidity, and, therefore, the ATDC sensors 601*a*~601*d* of the magnetic type for detecting the permeability of the developing material have outputs $V_{MA}$ which also change. The present embodiment uses the aforesaid characteristics to actuate the humidifying unit 402 and the routine returns when the outputs $V_{MA}$ of the ATDC sensors 601*a*~601*d* are greater than a predetermined value 2.8, and actuates the dehumidifying unit 401 and the routine returns when said outputs $V_{MA}$ are less than a predetermined value 2.6, as shown in FIG. 18.

Precision is improved by the values of the outputs $V_{MA}$ of the ATDC sensors 601*a*~601*d* to obtain average values for the various developing devices 45*a*~45*d*.

The present embodiment,similar to the improved precision achieved by the aforesaid use of the AIDC sensors, improves effectiveness on image quality stabilization and allows the charge amount Q to attain the normal humidity state more rapidly. Furthermore, the present embodiment suppresses the consumption of excess toner because test pattern development is not required.

Figure 19:
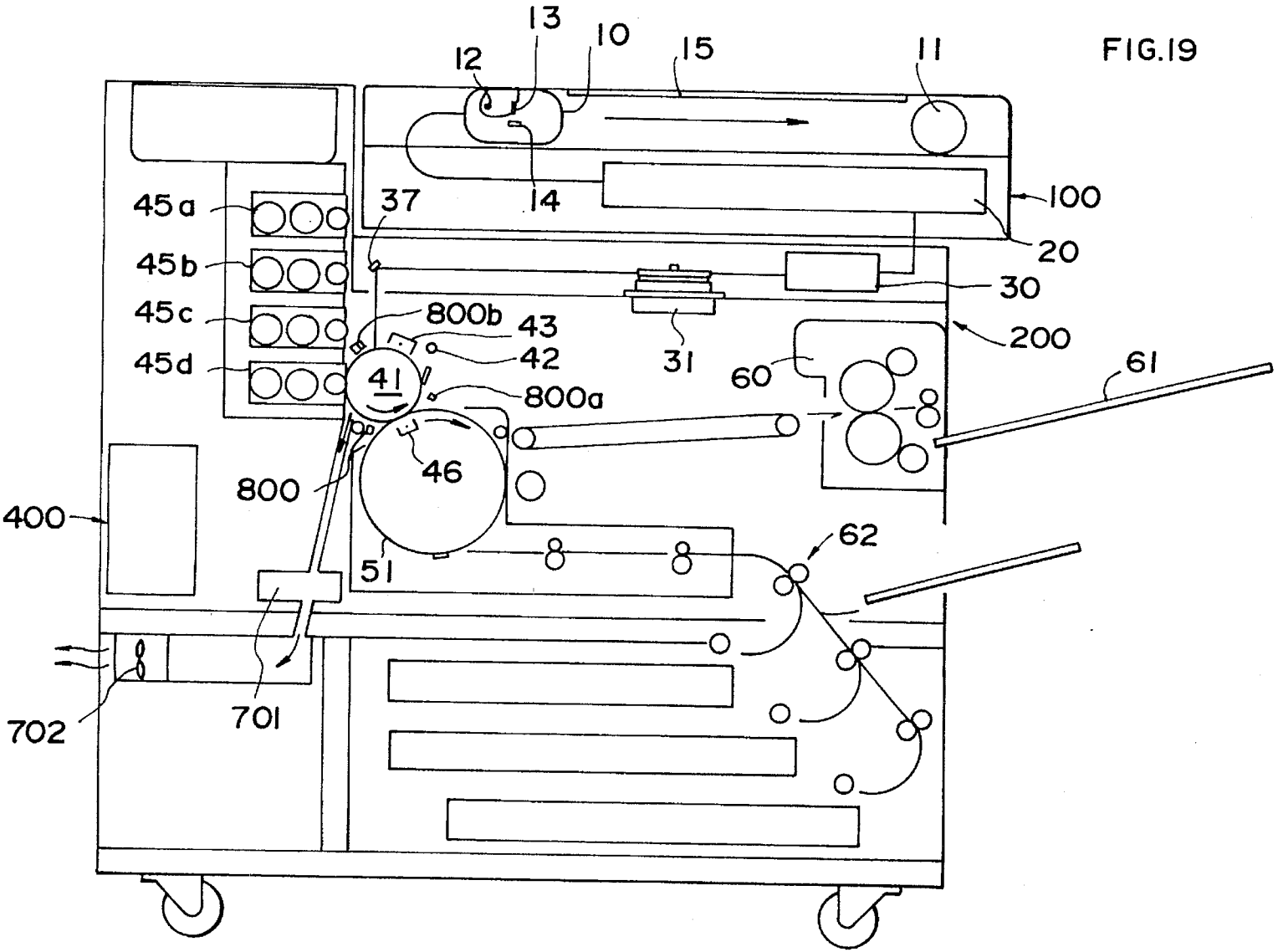

FIG. 19 shows a sixth embodiment of the present invention. In this embodiment, the amount of airborne toner dust output from the developing device is detected, and humidity control is accomplished in accordance with said detected toner output.

The sixth embodiment utilizes the fact that humidity affects the generation of airborne toner dust from the developing device.

When the relationship between humidity and airborne toner dust is studied, it is found that, in general, as the humidity increases, the amount of toner charge drops, thereby producing in a weak bonding to the carrier and a resulting increase in the amount of airborne toner dust. This airborne toner dust is mainly produced during the time when the developing material is transported from the developing device and supplied to the developing sleeve for developing.

As the amount of airborne toner dust increases, it produces contamination of the developing devices and soiling within the apparatus, and ultimately causing a deterioration in image quality thereby.

Conversely, airborne toner dust can be suppressed if a high humidity state can be avoided in proximity of the developing device.

Humidity is related to developer life. That is, generally when developing material has been used up to a high humidity state, the deterioration of the developing material occurs relatively rapidly in comparison to the deterioration which occurs at a normal humidity or low humidity state. Thus, the service life of the developing material is shortened.

Conversely, if the humidity is controlled so as to avoid producing a high humidity stat in proximity of the developing device, the developing material service life can be prolonged.

Humidity is related to the amount of developing material carried on the developing sleeve. As the humidity becomes higher, the flow characteristics of the developing material worsen, and the amount of developing material transported declines. Thus, developing efficiency is reduced and granularity is adversely affected.

Furthermore, humidity is also related to the residual potential Vr. As the humidity becomes higher, the fluctuation in Vr (for example, relative to the number of copies) becomes larger. Thus, the image density is not stable.

Accordingly, it is preferable that the humidity be controlled so as to maintain low humidity.

Since, in the present embodiment, the humidity is controlled in accordance with the detection of the amount of airborne toner dust, a unit 701 for detecting the amount of airborne toner dust is installed. The airborne toner dust is directed by means of a fan 702 or the like to the aforesaid unit 701. The actuation of the humidity controller 400 in accordance with the airborne toner dust detection results differs from the method of the second embodiment.

The unit 701 for detecting the amount of airborne toner dust may detect the amount of airborne toner dust by, for example, irradiating said dust with a laser beam and detecting the diffraction and scattering. Since the previously described correlations exist between the amount of airborne toner dust and the humidity, the humidity can be controlled by operating the humidity controller 400 in accordance with the detection value relative to the amount of airborne toner without consuming excess toner in the same manner as is achieved when using the ATDC sensor of the magnetic type, thereby effectively improving the precision of image stabilization and the like.

FIG. 20 shows a seventh embodiment of the invention. The present embodiment utilizes the fact that the amount Ms of the developing material transported on the developing sleeve of the developing device is affected by humidity in the manner previously described. The humidity controller 400 is operated in accordance with the aforesaid toner transport amount Ms.

The detection of the toner transport amount Ms is accomplished, for example, in the vicinities of the developing sleeves 702*a*~702*d* of the various developing devices 45*a*~45*d*. As shown in FIG. 20, the aforesaid detection is accomplishable by means of a combination of light-emitting diodes and photosensor 800*d*~800*g*. In this case, when a small toner amount Ms is transported, the light emitted from the light-emitting diode irradiates the developing material layer on the developing sleeve and more of said light is reflected therefrom by the developing sleeve, and the correlated increase in light impinging the photosensor 800d can be used to in the detection process. Precision is improved by using the average value of the various developing devices 45*a*~45*d* as the value of the toner transport amount Ms.

In comparison with conventional image stabilization systems, the present embodiment, in a manner similar to the previously described embodiments, improves the effectiveness of image stabilization by allowing the charge amount Q of the developing material to attain the normal humidity state more rapidly. The use of the Peltier element increases dehumidification efficiency and compactness.

When the humidity sensor is provided and its output utilizes a combination of the aforesaid volume density of the developing material and the detection value of the airborne toner amount, abnormalities in the ratio of toner to carrier in the developing material can be detected and the service life of said developing material can be determined.

Although each of the aforesaid embodiment of the invention has been described only in terms of using a Peltier element in the humidity controller, it is to be noted that the present invention is not limited to such an arrangement and that various other well known humidification, dehumidification and drying means may be used as deemed suitable.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

image forming means for forming images by an electrophotographic process;

adjusting means for adjusting humidity in an area around the image forming means;

detecting means for detecting the humidity in the area around the image forming means to output humidity data;

generating means for generating humidity historical data based on said humidity data; and control means for operating said adjusting means in accordance with said generated humidity historical data.

2. An image forming apparatus as claimed in claim 1 wherein said adjusting means includes a dehumidifying unit and a humidifying unit.

3. An image forming apparatus as claimed in claim 2 wherein said dehumidifying unit removes the moisture from the air by use of the cooling efficiency of a Peltier element.

4. An image forming apparatus comprising:

image forming means for forming images by an electrophotographic process;

adjusting means for adjusting humidity in an area around the image forming means;

detecting means for detecting the humidity in the area around the image forming means and outputting humidity data;

storing means for storing a plurality of the humidity data outputted within a fixed period;

generating means for periodically generating humidity historical data at predetermined time units based on the humidity data; and control means for operating said adjusting means in accordance with said generated humidity historical data.

5. An image forming apparatus as claimed in claim 4, further comprising:

warning means for warning an operator when said adjusting means is not normally operated.

6. An image forming apparatus as claimed in claim 4 wherein said generating means periodically generates the humidity historical data by calculating an average humidity from the stored humidity data.

7. An image forming apparatus as claimed in claim 4 wherein said storing means always stores a specific number of the humidity data.

8. A method performed in an image forming apparatus having image forming means for forming an image by an electrophotographic process, said method comprising the steps of:

detecting humidity in an area around the image forming means and outputting humidity data;

storing the humidity data in a memory upon the detection, the stored humidity data including the data outputted upon the latest humidity detection;

periodically generating humidity historical data at predetermined time units based on the stored humidity data; and adjusting the humidity in the area around the image forming means in accordance with said generated historical data.

9. A method as claimed in claim 8 further comprising the step of:

calculating an average humidity from the humidity data stored in said memory to generate the humidity historical data.

10. An image forming apparatus comprising:

image forming means for forming images by an electrophotographic process, said image forming means including a photoreceptor and developing means for developing an electrostatic latent image formed on the photoreceptor;

adjusting means for adjusting humidity in an area around the image forming means;

detecting means for detecting electrical characteristics of the photoreceptor relating to humidity; and control means for operating said adjusting means in accordance with said detected electrical characteristics.

11. An image forming apparatus as claimed in claim 10 wherein the image density is also adjusted in accordance with the detected electrical characteristics.

12. An image forming apparatus as claimed in claim 10 wherein said adjusting means includes a dehumidifying unit and a humidifying unit.

13. An image forming apparatus as claimed in claim 12 wherein said dehumidifying unit removes the moisture from the air by use of the cooling efficiency of a Peltier element.

14. An image forming apparatus comprising:

image forming means for forming images by an electrophotographic process, said image forming means includes developing means for developing an electrostatic latent image formed on a photoreceptor;

detecting means for detecting a density of the developed image;

adjusting means for adjusting humidity in an area around the image forming means; and control means for operating said adjusting means in accordance with a detection result obtained by said detecting means.

15. An image forming apparatus as claimed in claim 14 further comprising:

second control means for adjusting the image density in accordance with the detection result obtained by the detecting means.

16. An image forming apparatus as claimed in claim 14 wherein said image forming means further includes transfer means for transferring the developed image on a sheet, and said detecting means is provided at least on an upstream side from said transfer means with respect to a rotation direction of the photoreceptor.

17. An image forming apparatus comprising:

image forming means for forming images by an electrophotographic process, said image forming means including a rotatable photoreceptor, charging means for charging a photoreceptor surface, and exposure means for exposing the charged surface of the photoreceptor to form an electrostatic latent image on the photoreceptor;

detecting means for detecting a voltage of the surface of the photoreceptor;

adjusting means for adjusting humidity in an area around the image forming means; and control means for operating said adjusting means in accordance with the detection result obtained by said detecting means.

18. An image forming apparatus as claimed in claim 17 further comprising:

second detecting means for detecting a density of the developed images, and wherein said image forming means further includes developing means for developing said electrostatic latent image on the photoreceptor, and said control means operates said adjusting means in accordance with the detection result obtained by the first and second detecting means.

19. An image forming apparatus comprising:

image forming means for forming images by an electrophotographic process, said image forming means includes a developing unit accommodating two-component developing materials with which an electrostatic latent image formed on a photoreceptor is developed;

detecting means for detecting volume densities of take developing materials;

adjusting means for adjusting humidity in an area around the image forming means; and control means for operating said adjusting means in accordance with the detection result obtained by said detecting means.

20. An image forming apparatus comprising:

image forming means for forming images by an electrophotographic process, said image forming means includes a developing unit for accommodating a developer with which an electrostatic latent image formed on a photoreceptor is developed;

detecting means for detecting an amount of the developer scattered from said developing unit;

adjusting means for adjusting humidity in an area around the image forming means; and control means for operating said adjusting means in accordance with the detection result obtained by said detecting means.

21. An image forming apparatus comprising:

image forming means for forming images by an electrophotographic process, said image forming means includes a developing unit wherein an electrostatic latent image formed on a photoreceptor is developed with a developer transported on a developing roller in said developing unit;

detecting means for detecting an amount of the developer transported on said developing roller in said developing unit;

adjusting means for adjusting humidity in an area around the image forming means; and control means for operating said adjusting means in accordance with the detection result obtained by said detecting means.

22. A method performed in an image forming apparatus having image forming means for forming images by an electrophotographic process, said image forming means including developing means for developing an electrostatic latent image formed on a photoreceptor, said method comprising the steps of:

detecting electrical characteristic of the photoreceptor of the image forming means relating to humidity; and adjusting humidity in an area around the image forming means in accordance with said detected electrical characteristics.

23. An image forming apparatus comprising:

image forming means for forming images by an electrophotographic process, said image forming means including a developing unit accommodating a developer;

adjusting means for adjusting humidity in an area around the image forming means;

detecting means for detecting electrophotographic characteristics of the developer relating to humidity in the area around the image forming means; and control means for operating said adjusting means in accordance with said detected electrophotographic characteristics of the developer.

24. An image forming apparatus comprising:

image forming means for forming images;

adjusting means for adjusting humidity in an area around the image forming means;

detecting means for detecting electrical characteristics of the image forming means; and control means for operating said adjusting means in accordance with said detected electrical characteristics.

25. A method performed in an image forming apparatus having image forming means for forming images, said method comprising the steps of:

detecting electrical characteristics of the image forming means; and adjusting humidity in an area around the image forming means in accordance with said detected electrical characteristics.

* * * * *